US008424461B2

(12) United States Patent
Goebels et al.

(10) Patent No.: US 8,424,461 B2
(45) Date of Patent: Apr. 23, 2013

(54) PASSAGEWAY BETWEEN TWO CARRIAGES OF A RAIL VEHICLE, IN PARTICULAR A HIGH-SPEED RAIL VEHICLE

(75) Inventors: André Goebels, Kassel (DE); Volker Jünke, Felsberg (DE)

(73) Assignee: Hübner GmbH, Kassel (DE)

( * ) Notice: Subject to any disclaimer, the term of this patent is extended or adjusted under 35 U.S.C. 154(b) by 0 days.

(21) Appl. No.: 13/361,231

(22) Filed: Jan. 30, 2012

(65) Prior Publication Data

US 2012/0204754 A1 Aug. 16, 2012

(30) Foreign Application Priority Data

Feb. 16, 2011 (EP) ..... 11001263
Mar. 1, 2011 (EP) ..... 11001681

(51) Int. Cl.
*B60D 5/00* (2006.01)

(52) U.S. Cl.
USPC ..... 105/8.1; 105/9; 105/15

(58) Field of Classification Search ..... 105/8.1, 105/9, 15, 18, 19, 20
See application file for complete search history.

(56) References Cited

U.S. PATENT DOCUMENTS

| | | | | | |
|---|---|---|---|---|---|
| 503,160 | A * | 8/1893 | Perry | 105/18 |
| 2,568,684 | A * | 9/1951 | Mihalyi | 105/18 |
| 3,410,226 | A * | 11/1968 | Krupp | 105/10 |
| 4,318,345 | A * | 3/1982 | Kleim | 105/15 |
| 4,690,421 | A * | 9/1987 | Schmidt et al. | 280/403 |
| 4,798,148 | A * | 1/1989 | Girard | 105/17 |
| 4,819,565 | A * | 4/1989 | Bechu | 105/11 |
| 4,942,825 | A * | 7/1990 | Britzke et al. | 105/18 |
| 5,060,577 | A * | 10/1991 | Steinmetz | 105/15 |
| 5,562,042 | A * | 10/1996 | Luck et al. | 105/8.1 |
| 2005/0183622 | A1 * | 8/2005 | Petit et al. | 105/8.1 |
| 2009/0193999 | A1 * | 8/2009 | Gomis | 105/18 |
| 2012/0204754 | A1 * | 8/2012 | Goebels et al. | 105/15 |

FOREIGN PATENT DOCUMENTS

EP 293051 A1 * 11/1988

* cited by examiner

*Primary Examiner* — Jason C Smith
(74) *Attorney, Agent, or Firm* — Gifford, Krass, Sprinkle, Anderson & Citkowski, P.C.

(57) ABSTRACT

A passageway between two carriages of a rail vehicle, in particular a high-speed rail vehicle, wherein the passageway comprises an inner bellows and, disposed at a distance to said, an outer bellows to form an interior space, wherein the two bellows are each attached to the end face of the vehicle, wherein the two bellows are each designed in their circumference in a box shape, and that the interior space contains a means for at least a partial pressure compensation.

9 Claims, 1 Drawing Sheet

PASSAGEWAY BETWEEN TWO CARRIAGES OF A RAIL VEHICLE, IN PARTICULAR A HIGH-SPEED RAIL VEHICLE

CROSS-REFERENCE TO RELATED APPLICATIONS

This application claims priority of European Patent Application EP 11 001 263.0 filed Feb. 16, 2011, and European Patent Application EP 11 001 681.3 filed Mar. 1, 2011.

FIELD OF THE INVENTION

The invention relates to a passageway between two carriages of a rail vehicle, in particular a high-speed rail vehicle, wherein the passageway comprises an inner bellows and, disposed at a distance to said, an outer bellows, forming an interior space, wherein the two bellows are each attached to the end face of the vehicle, wherein the two bellows are each box shaped in their circumference.

BACKGROUND OF THE INVENTION

Passageways, in particular for high-speed rail vehicles, are sufficiently known from the prior art. The passageways typically comprise two bellows, wherein the bellows encompass, in a box shape, a passageway bridge between the two carriages of a rail vehicle. A bellows construction of this type is "pressure-tight"; by "pressure-tight" one understands it to mean that when a bellows, over the course of a certain time period, is subjected to an excess of pressure, or a negative pressure, respectively, the pressure is not allowed to fall below or climb above a certain value, with respect to time.

It is known that when entering a tunnel, particularly when two trains meet in a tunnel, considerable pressure surges occur. Measurements in this context have shown that, in extreme cases, pressures of up to many kilopascals are applied to the outer surface of the train, and of course, in this respect, to the passageway construction having the bellows, when two trains meet in a tunnel at the midpoint of said tunnel. Once the two trains have passed each other, a negative pressure occurs in the range of likewise many kilopascals. As a result, very considerable deformation occurs in the region of the bellows, wherein it has been established that the outer bellows is deformed radially by a pressure surge of this type to the extent of approx. 20 cm inwards and outwards. When deformed to such a degree, the bellows frames reach their yield point in certain circumstances, i.e. they potentially arrive at the point of plastic deformation. This means that in adverse circumstances it may occur that the bellows frames may be damaged when subjected to recurring loads. The reason for the extreme deformation of the outer bellows, both by an excess of pressure, as well as with a negative pressure, with respect to the inner bellows, rests substantially on two factors. The first factor is that the outer bellows is substantially larger than the inner bellows. With high-speed trains it is becoming increasingly more common to connect the outer bellows between the two vehicles such that it is flush with the outer surface of said. In contrast, the inner bellows exhibits a relatively substantially smaller radial expansion. The result of this is that the outer bellows exhibits a significantly larger surface area than the inner bellows, which results in the bellows being subjected to a greater degree of deformation. The inner bellows, however, is protected by the outer bellows, such that due to these factors, significantly lower pressures exist in the space between the two bellows, which lead to a deformation of the inner bellows. In this regard, it has been established by measurements that the pressure exerted on the inner bellows amounts to approximately one half of the pressure to which the outer bellows is subjected. This pressure is the result of the deformation of the outer bellows and the resulting change of volume between the bellows. The inner bellows tends to be deformed to a lesser degree for these reasons, due to the smaller surface area and due to the relatively high degree of stiffness as a result of the shorter tangential expansion of the bellows frames having the same cross-section of the bellows frame as that of the outer bellows.

With this background, the invention assumes the objective of minimizing the deformations of the outer bellows that occurs during pressure surges, such as are described above.

BRIEF DESCRIPTION OF THE INVENTION

To attain the objective, it is proposed according to the invention that the interior space include a means for at least a partial pressure compensation. By means of a pressure compensation, or partial pressure compensation of this type between the interior space and the exterior, the outer bellows is no longer substantially deformed, or only deformed to a limited degree when subjected, accordingly, to pressure surges. With a complete pressure compensation, the same pressure would be exerted on the inner surface of the outer bellows as that exerted on the outer surface of the outer bellows.

With respect to the inner bellows, it has been stated that said, due to its smaller circumference, i.e. its substantially smaller radial expansion, having the same structural design as the outer bellows is substantially stiffer. In this respect, when a pressure surge occurs, the exact same pressure would be exerted on the outer surface of the inner bellows as that exerted on the outer bellows. Because the inner bellows, however, due to it size, is significantly stiffer, it is fully capable of better withstanding such pressure surges. This means that even with pressures to the same degree as those exerted on outer bellows, the inner bellows would only be deformed to a substantially lesser degree than is the case for the outer bellows, which likewise results in the effect to persons in the region of the passageway being substantially smaller. There is, however, the possibility that the inner bellows be designed to be stiffer, which may result, for example, from the use of bellows frames having a larger cross-section. Although this results in a heavier weight, the additional weight for the inner bellows is still significantly smaller due to the difference in size to the outer bellows, such that even with a reinforced inner bellows, it would only tend to sag in its circumference to a small degree, in contrast to what would be the case for an outer bellows, if its bellows frame were reinforced. It can be derived directly from this that the outer bellows only serves the function, substantially, of forming a passageway, with which the outer bellows is externally flush with the external wall of the carriage, thereby substantially improving the aerodynamics in comparison with a passageway structure in which the outer bellows is offset radially inwards in relation to the outer surface of the carriage walls.

Advantageous characteristics and embodiments are derived from the dependent claims.

As such it is provided, in particular, that the interior space contain at least one opening, preferably in the outer bellows, as a means for pressure compensation. From this it is clear that with a pressure surge, having an effect to the outer surface of the bellows, of an excess pressure or negative pressure, the pressure in the interior space is the same as that in the surroundings. For this, it is to be taken into account that the shock wave that occurs when a train enters a tunnel, and when, in particular, two trains meet in the middle of a tunnel, is propagated at the speed of sound.

It is also conceivable to implement one or more valve(s) in one or more opening(s). The implementation of valves has the advantage that these can be configured such that the pressure in the interior space does not exceed a definable value.

According to a particularly advantageous characteristic of the invention, it is provided that an inflatable container is connected to the opening, which is located in the interior space between the two bellows. A container of this sort, by way of example, designed as a bladder made of an elastomer substance, results in the volume of the bladder increasing immediately when an excess of pressure occurs, to the extent that the same pressure is exerted to the inner surface of the outer bellows as that exerted to the outer surface. The advantage of the use of a container of this type is, in particular, that for this the danger of dirt or moisture entering the interior space of the bellows during the air exchange does not exist. Dirt and moisture can only enter the container, i.e. the bladder, which, if necessary, can be inverted for cleaning.

In order to fully ensure that the same pressure occurs on the inner surface of the outer bellows and the outer surface of the outer bellows with the use of a bladder of this sort, it is important that the maximal volume of the container corresponds to the maximal difference in volume in the interior space between the two bellows. It is also the case here that through the implementation of valves or chokes, as well, only a partial pressure compensation can be achieved.

Based on the drawings, the invention shall be explained in the following in greater detail by means of examples.

DETAILED DESCRIPTION OF THE INVENTION

Figure 1:
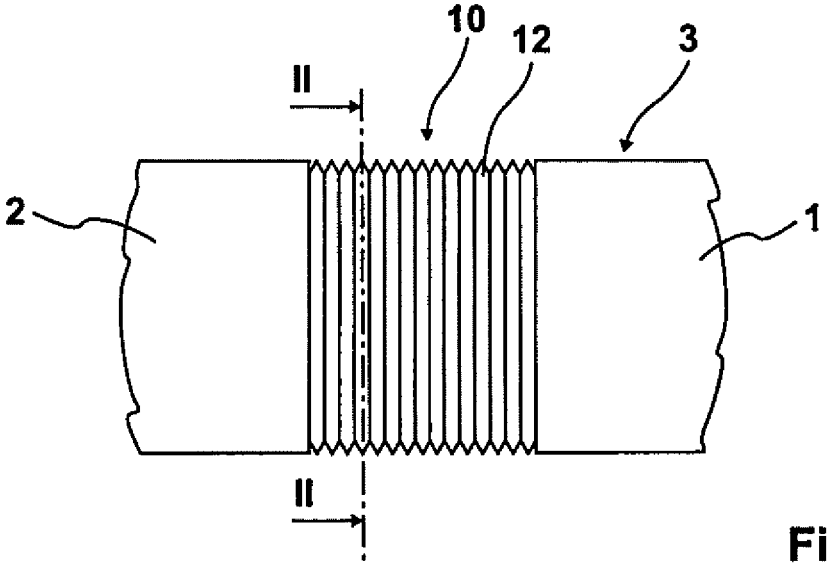
FIG. 1 shows a schematic illustration of a passageway having a bellows between two carriages of a rail vehicle.
Figure 2:
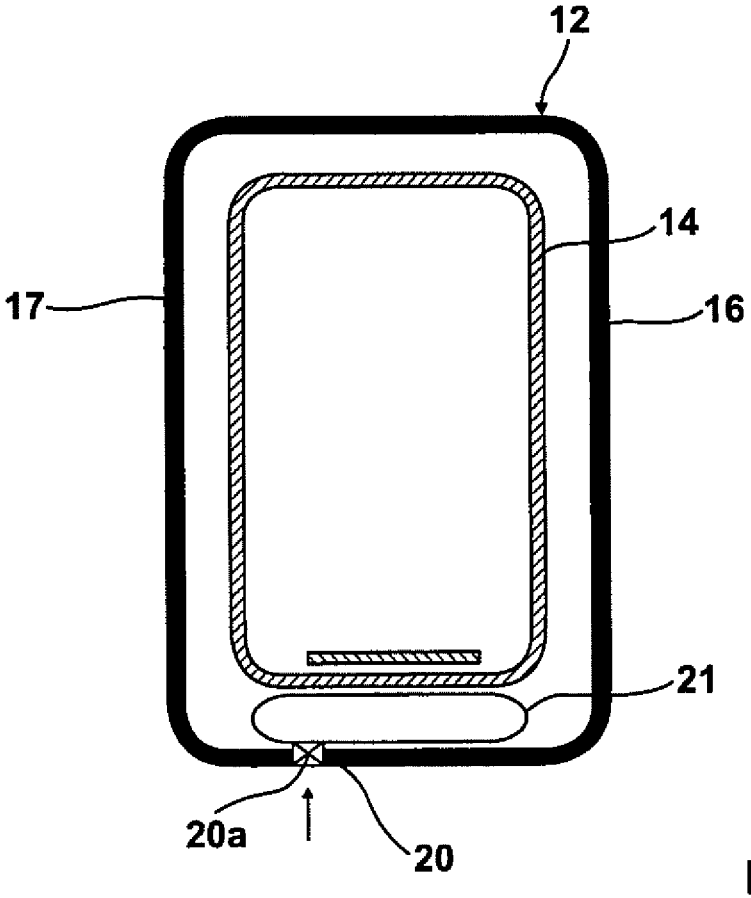
FIG. 2 shows a cross-section cut in accordance with the line II-II in FIG. 1.

The two carriages 1 and 2 of the rail vehicle 3 are connected to one another by means of the passageway 10 with the dual-wave bellows 12. The dual-wave bellows 12 comprises the inner bellows 14 and the outer bellows 16, wherein the two bellows 14 and 16 are disposed at a distance to one another to form an interior space 17. The outer bellows 16 has one opening 20, wherein an inflatable container 21 can be connected to the opening 20. This inflatable container 21 is, in particular, also stretchable, in a manner similar to a balloon. It is also conceivable, however, that the container only be designed to be inflatable, with the background that the maximal volume of said container 21, or the bladder, corresponds exactly to the displaced volume when the outer bellows deforms towards the inner bellows. The opening 20 may be provided with a valve 20*a*. The extent of the pressure increase in the interior space 17 can be established by means of the valve 20*a*, for example.

The invention claimed is:

1. A passageway between two carriages of a rail vehicle, the passageway comprising:

an inner bellows extending between an end face of a first carriage and an end face of a second carriage, the inner bellows having a generally box shaped circumference; and an outer bellows which is spaced from the inner bellows and encloses the inner bellows so as to define an interior space between the inner and outer bellows, the outer bellows extending between an end face of a first carriage and an end face of a second carriage, the outer bellows having a generally box shaped circumference;

the interior space having at least one opening; and an inflatable container disposed in the interior space, the container being connected to the opening;

wherein the inflatable container provides at least a partial pressure compensation for the interior space.

2. A passageway in accordance with claim 1, wherein the opening is disposed in the outer bellows.

3. A passageway in accordance with claim 1, wherein the maximal volume of the inflatable container corresponds to the maximal difference in volume in the interior space between the inner and outer bellows.

4. A passageway in accordance with claim 1, further comprising a choke or a valve disposed in the opening.

5. A passageway between two carriages of a rail vehicle, the passageway comprising:

an inner bellows extending between an end face of a first carriage and an end face of a second carriage, the inner bellows having a generally box shaped circumference; and an outer bellows which is spaced from the inner bellows and encloses the inner bellows so as to define an interior space between the inner and outer bellows, the outer bellows extending between an end face of a first carriage and an end face of a second carriage, the outer bellows having a generally box shaped circumference;

wherein the interior space has an opening allowing at least a partial pressure compensation between the interior space and the surroundings of the passageway when an excess or negative pressure on an outer surface of the outer bellows deforms the outer bellows.

6. A passageway in accordance with claim 5, wherein the opening is disposed in the outer bellows.

7. A passageway in accordance with claim 5, further comprising a choke or a valve disposed in the opening.

8. A passageway in accordance with claim 5, further comprising:

an inflatable container disposed in the interior space, the container being connected to the opening;

wherein the inflatable container provides at least a partial pressure compensation for the interior space.

9. A passageway in accordance with claim 8, wherein the maximal volume of the inflatable container corresponds to the maximal difference in volume in the interior space between the inner and outer bellows.

* * * * *